US011655783B2

(12) United States Patent
Kwak et al.

(10) Patent No.: US 11,655,783 B2
(45) Date of Patent: May 23, 2023

(54) AIR CLEANER FOR VEHICLES

(71) Applicants: HYUNDAI MOTOR COMPANY, Seoul (KR); KIA CORPORATION, Seoul (KR)

(72) Inventors: Seong Youn Kwak, Suwon-si (KR); Sung Hyuk Yoon, Seoul (KR); Sung Min Yang, Incheon (KR); Ju Ho Han, Suwon-si (KR); Won Seop Choi, Anyang-si (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 65 days.

(21) Appl. No.: 17/331,140

(22) Filed: May 26, 2021

(65) Prior Publication Data

US 2022/0128020 A1 Apr. 28, 2022

(30) Foreign Application Priority Data

Oct. 27, 2020 (KR) ..... 10-2020-0140039

(51) Int. Cl.

| | |
|---|---|
| ***F02M 35/024*** | (2006.01) |
| ***F02M 35/02*** | (2006.01) |
| ***F02M 35/10*** | (2006.01) |
| ***F02M 35/12*** | (2006.01) |

(52) U.S. Cl.

CPC .. *F02M 35/02416* (2013.01); *F02M 35/0204* (2013.01); *F02M 35/0218* (2013.01); *F02M 35/0245* (2013.01); *F02M 35/02475* (2013.01); *F02M 35/10262* (2013.01); *F02M 35/1255* (2013.01)

(58) Field of Classification Search

CPC ..... F02M 35/02416; F02M 35/0204; F02M 35/0218; F02M 35/0245; F02M 35/02475; F02M 35/10262; F02M 35/1255; F02M 35/14; F02M 35/024; F02M 35/0201; F02M 35/02491

See application file for complete search history.

(56) References Cited

U.S. PATENT DOCUMENTS 5,891,207 A * 4/1999 Katta ..... B01D 46/103 55/505
2017/0319997 A1 11/2017 Jerger

FOREIGN PATENT DOCUMENTS

| | | | | |
|---|---|---|---|---|
| CN | 108691702 | A * | 10/2018 | ..... B01D 46/0005 |
| DE | 10 2014 224764 | A | 6/2016 | |
| EP | 2981700 | B | 3/2014 | |
| KR | 10-1714219 | B | 3/2017 | |
| KR | 10-2017-0104649 | A | 9/2017 | |

* cited by examiner

*Primary Examiner* — Jacob M Amick
*Assistant Examiner* — Charles J Brauch
(74) *Attorney, Agent, or Firm* — Lempia Summerfield Katz LLC

(57) ABSTRACT

An air cleaner for vehicles includes: a case having an inlet, through which outside air is introduced, and an outlet, through which filtered air is discharged; and a filter installed in an inner space of the case, configured to filter the outside air introduced through the inlet, and including a filtration member, wherein the filtration member is formed in an "∩" shape open downwards and is configured to allow the outside air to pass therethrough in a downward direction and in a lateral direction.

19 Claims, 14 Drawing Sheets

AIR CLEANER FOR VEHICLES

CROSS-REFERENCE TO RELATED APPLICATION

This application claims priority to and the benefit of Korean Patent Application No. 10-2020-0140039, filed on Oct. 27, 2020, the entire contents of which are incorporated herein by reference.

FIELD

The present disclosure relates to an air cleaner for vehicles.

BACKGROUND

The statements in this section merely provide background information related to the present disclosure and may not constitute prior art.

An engine of a vehicle requires air to burn fuel, and receives air necessary at the time of combustion from outside the vehicle through an intake system. The intake system is configured to supply air to a combustion chamber of the engine to maintain engine performance, and includes an air cleaner configured to remove foreign matter from air.

In the intake system of the vehicle engine, outside air introduced through an intake duct is filtered by the air cleaner to form clean air, and the clean air is supplied to the engine through an intake hose. A filter configured to allow the outside air to pass therethrough to remove foreign matter from the air is provided in the air cleaner.

In general, an air cleaner for vehicles may be classified as a vertical flow type air cleaner, in which air introduced into a case passes through a filter from below to above or from above to below, or a horizontal flow type air cleaner, in which air introduced into a case passes through a filter from inside to outside or from outside to inside.

However, the height and volume of a conventional air cleaner are large to provide a sufficient flow channel of air passing through a filter in a case. In addition, the filter is stably supported in the case of the air cleaner. Furthermore, a body and a cover forming the case is be stably supported and stiffness thereof must be provided. We have discovered that reducing the height and volume of the air cleaner and improving for maintaining a rigid support structure and securing stiffness are desired.

In addition, it is desirable to further simplify the structure for reduction in the number of parts, cost, and weight. In particular, for a hybrid electric vehicle, an improved structure in which the height of the filter is reducible while the filter has sufficient area and filtration performance is desired.

The above information disclosed in this Background section is provided only for enhancement of understanding of the background of the disclosure and therefore it may contain information that does not form the prior art that is already known to a person of ordinary skill in the art.

SUMMARY

The present disclosure provides an air cleaner configured such that a filter is stably supported in a case and a filter support structure is simplified to remove undesired parts, whereby it is possible to reduce cost and weight and to reduce the height of the filter.

The present disclosure provides an air cleaner for vehicles, the air cleaner including: a case including an inlet, through which outside air is introduced, and an outlet, through which filtered air is discharged; and a filter installed in an inner space of the case, configured to filter the outside air introduced through the inlet, and including a filtration member, wherein the filtration member is formed in an "n" shape open downwards and is configured to allow the outside air to pass therethrough in a downward direction and in a lateral direction.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
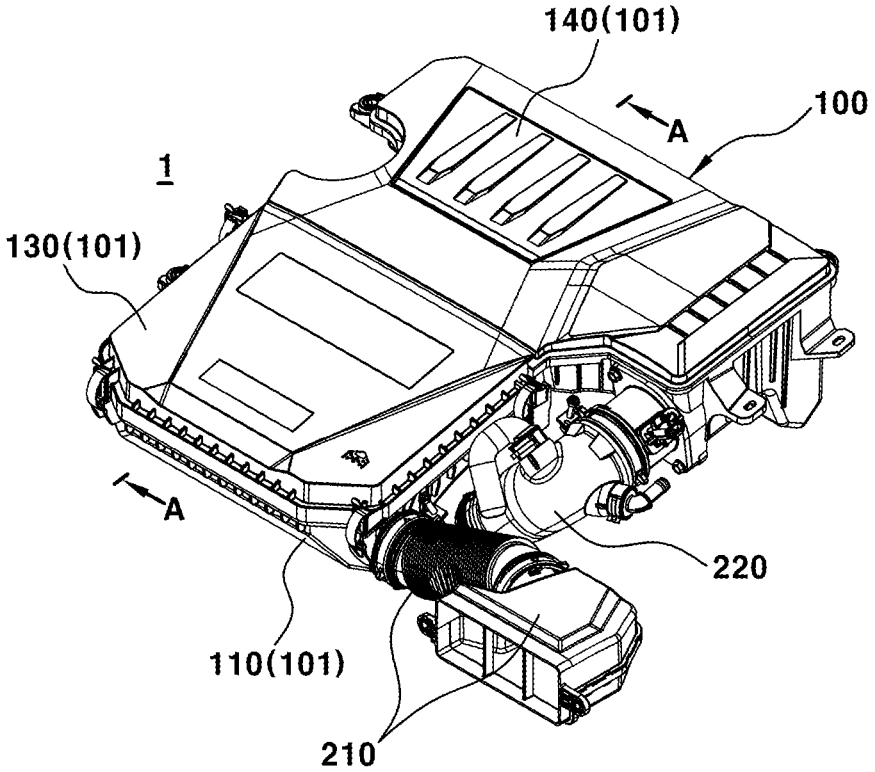
FIG. 1 is a perspective view showing an air cleaner according to one form of the present disclosure and an intake system.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

It will be understood that, although the terms "first", "second", etc. may be used herein to describe various elements, corresponding elements should not be understood as being limited by these terms, which are used only to distinguish one element from another. For example, within the scope defined by the present disclosure, a first element may be referred to as a second element, and similarly, a second element may be referred to as a first element.

It will be understood that, when a component is referred to as being "connected to" or "coupled to" another component, it may be directly connected to or coupled to the other component, or intervening components may be present. In contrast, when a component is referred to as being "directly connected to" or "directly coupled to" another component, there are no intervening components present. Other terms that describe the relationship between components, such as "between" and "directly between" or "adjacent to" and "directly adjacent to", must be interpreted in the same manner.

Wherever possible, the same reference numbers will be used throughout the drawings to refer to the same or like parts. The terms used in this specification are provided only to explain specific forms, but are not intended to restrict the present disclosure. A singular representation may include a plural representation unless it represents a definitely different meaning from the context. It will be further understood that the terms "comprises", "comprising" and the like, when used in this specification, specify the presence of stated components, steps, operations, and/or elements, but do not preclude the presence or addition of one or more other components, steps, operations, and/or elements.

Hereinafter, various forms of the present disclosure will be described in detail with reference to the accompanying drawings.

Figure 2:
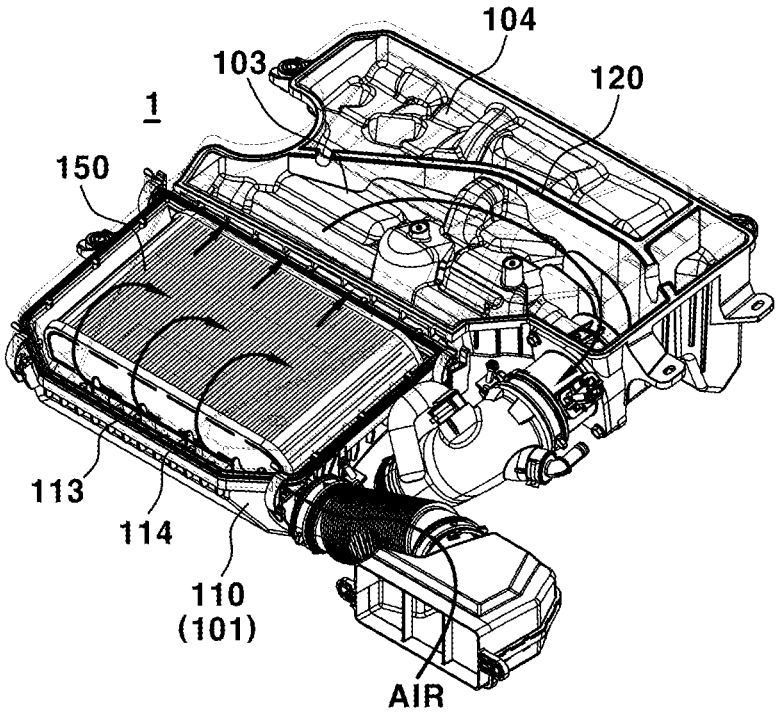
FIG. 2 is a perspective view showing inner construction of the air cleaner according to one form of the present disclosure.
Figure 3:
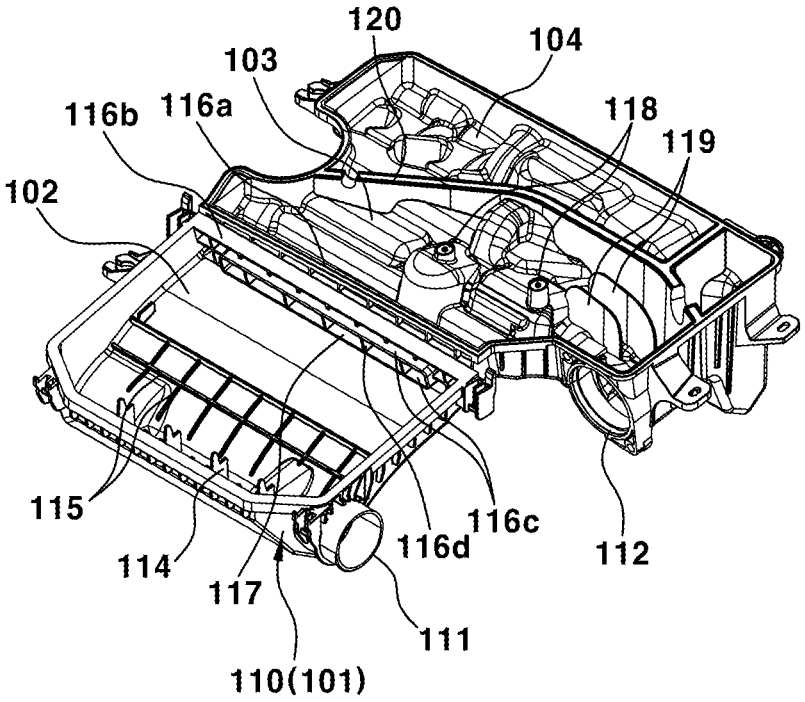
FIGS. 3 and 4 are perspective views showing a body of the air cleaner according to one form of the present disclosure.
Figure 4:
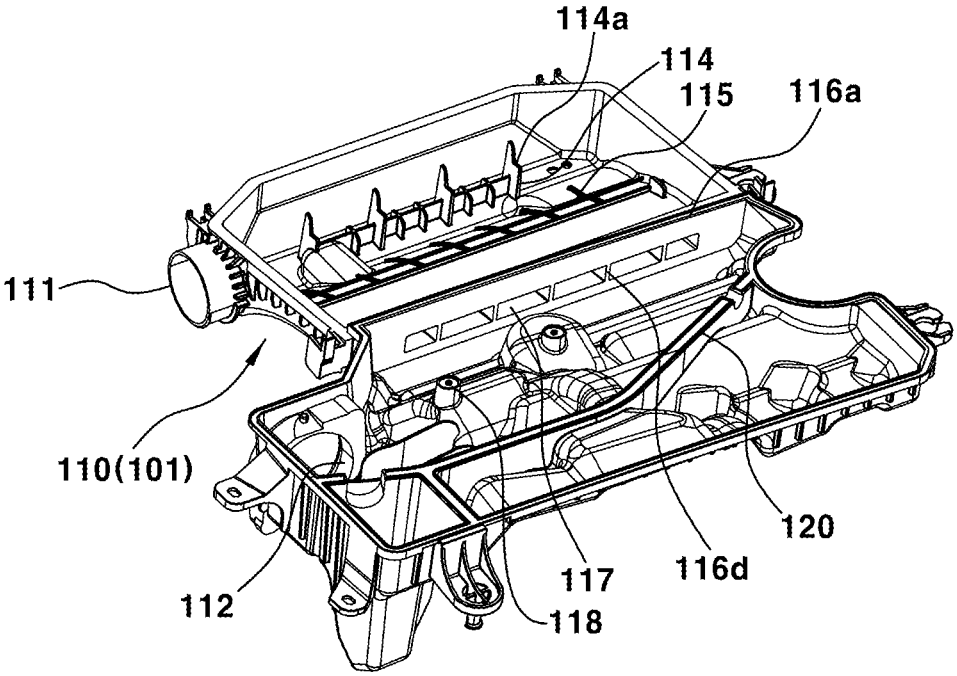

FIG. 1 is a perspective view showing an air cleaner 100 according to one form of the present disclosure and an intake system, and FIG. 2 is a perspective view showing inner construction of the air cleaner according to one form of the present disclosure. In addition, FIGS. 3 and 4 are perspective views showing a body of the air cleaner according to one form of the present disclosure.

Figure 5:
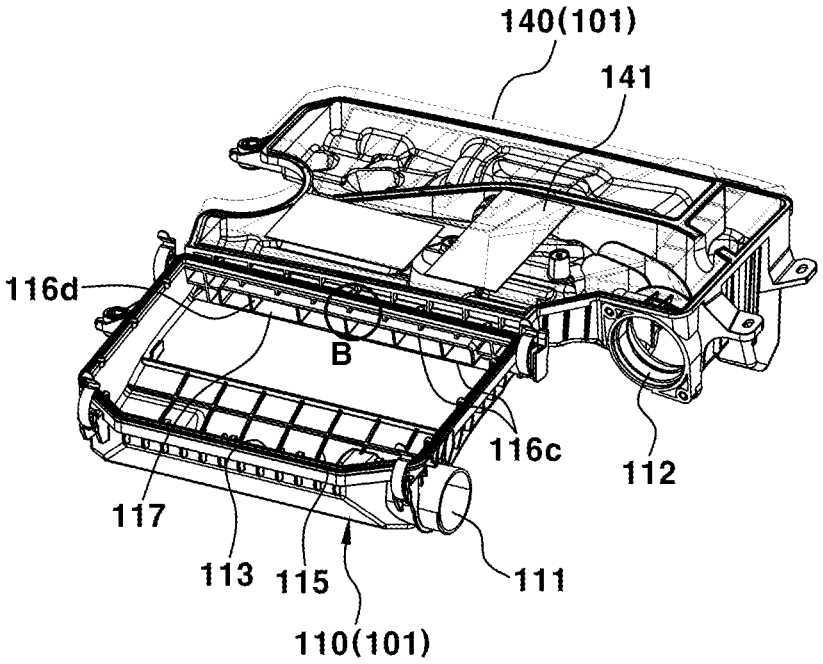
FIG. 5 is a perspective view showing the air cleaner according to one form of the present disclosure in the state in which a first cover is removed therefrom.
Figure 6:
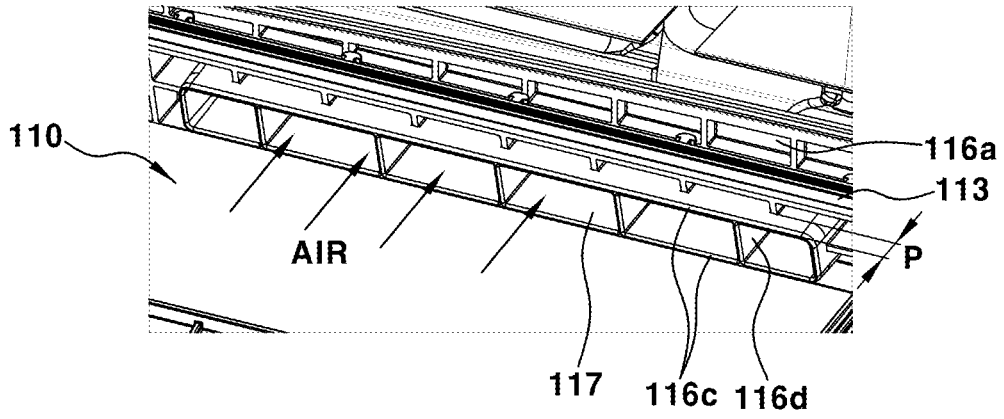
FIG. 6 is an enlarged perspective view of part B of FIG. 5.
Figure 7:
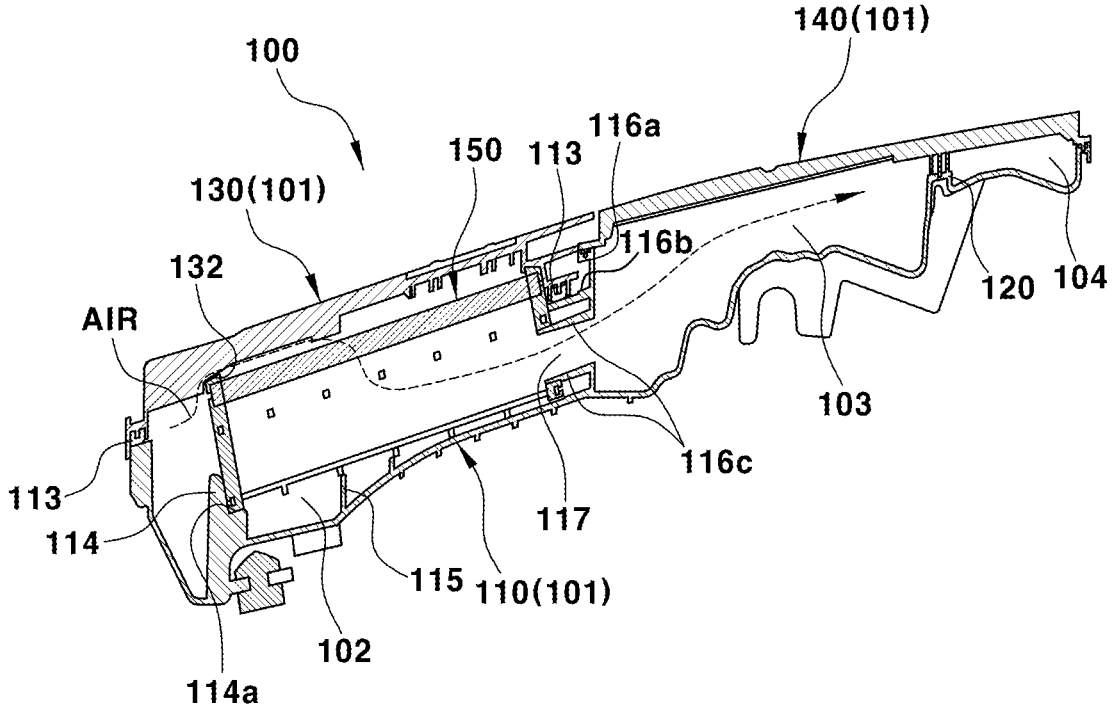
FIG. 7 is a sectional view of the air cleaner according to one form of the present disclosure taken along line A-A of FIG. 1.

In addition, FIG. 5 is a perspective view showing the air cleaner according to one form of the present disclosure in the state in which a first cover is removed therefrom, and FIG. 6 is an enlarged perspective view of part B of FIG. 5. In addition, FIG. 7 is a sectional view of the air cleaner 100 according to one form of the present disclosure taken along line A-A of FIG. 1.

The air cleaner 100 according to one form of the present disclosure is an air cleaner usable in an intake system of a hybrid electric vehicle (HEV).

As shown, the air cleaner 100 according to one form of the present disclosure includes a case 101 having an inner space that is hermetically sealed and a filter 150 mounted in the case 101. The case 101 includes a body 110 and a cover 130, 140 assembled to the upper side of the body 110. Here, the cover includes a first cover 130 and a second cover 140.

The body 110 is provided at one side and the other side thereof with an inlet 111, through which outside air is introduced, and an outlet 112, through which filtered air (clean air) is discharged, respectively. An intake duct 210 configured to guide outside air to the air cleaner 100 is connected to the inlet 111 of the body 110. An intake hose 220 configured to guide air passing through the air cleaner 100 to an electronic throttle controller (ETC) is installed at the outlet 112 of the body 110. An airflow sensor (AFS) (not shown) may be installed in the intake hose 220.

The inner space of the body 110 is partitioned into three parts. Although the inner spaces of the three parts are divided from each other, the three parts are connected to each other and form the entirety of the body 110. One of the three parts is a filter receiving portion 102 configured to receive the filter 150, another part connected to the filter receiving portion 102 is a part forming an enlarged pipe portion 103, and another part connected to the enlarged pipe portion 103 is a part forming a resonator 104. In the state in which the first cover 130 and the second cover 140 are assembled to the upper side of the body 110 to hermetically seal the inner spaces, therefore, the filter receiving portion 102, the enlarged pipe portion 103, and the resonator 104 are integrally connected to each other in the case 101 of the air cleaner 100.

In the case 101 of the air cleaner 100, the outlet 112 may be formed in the body 110, and is located at one side of the part forming the enlarged pipe portion 103 of the body 110. In the state in which the filter 150 is received in the filter receiving portion 102, therefore, air guided through the intake duct 210 is introduced into the filter receiving portion 102 through the inlet 111 of the body 110 and passes through the filter 150. During passage through the filter 150, foreign matter is removed from the air. The air from which foreign matter has been removed (clean air) passes through the enlarged pipe portion 103 and is discharged to the intake hose 220 through the outlet 112.

That is, in the case 101, the inner space of the filter receiving portion 102 is a dirty side, and the inner space of the enlarged pipe portion 103 is a clean side. The dirty side is a space in which air before filtration, i.e. outside air, is introduced and flows towards the filter 150, and the clean side is a space through which filtered air, i.e. air from which foreign matter has been removed by the filter 150 (clean air), passes.

The first cover 130 and the second cover 140 are assembled to the upper side of the body 110, and form the filter receiving portion 102, the enlarged pipe portion 103, and the resonator 104, which have a hermetically sealed structure, in the state of being assembled to the body 110. At this time, the first cover 130 is assembled to the body 110 to cover the filter receiving portion 102 and the upper side of the filter 150 received in the filter receiving portion 102, and the second cover 140 is assembled to the body 110 to cover the inner spaces of the enlarged pipe portion 103 and the resonator 104.

The enlarged pipe portion 103 is a part forming the clean side, and is a space through which air filtered by the filter 150 passes. The enlarged pipe portion 103 performs the function of a surge tank in a conventional intake system 1, reduces the speed of air introduced into the air cleaner 100 and at the same time reduces flow resistance. Consequently, the enlarged pipe portion 103 serves to stabilize a flow channel of air introduced into an engine, thereby improving engine performance and reducing noise.

The resonator 104 may be a Helmholtz type resonator. The resonator 104 serves to reduce noise together with the enlarged pipe portion 103, and serves to further reduce noise in addition to noise reduction by the enlarged pipe portion 103. That is, the resonator 104 reduces a specific-frequency component of the noise that has not been removed by the enlarged pipe portion 103, thereby reducing engine wavelengths and thus improving NVH performance.

In FIGS. 3 and 5, reference symbol 120 indicates a boundary portion configured to partition the inner space of the enlarged pipe portion 103 and the inner space of the resonator 104 from each other in the body 110. The boundary portion 120 is formed on the inner bottom surface of the body 110 along a boundary part between the enlarged pipe portion 103 and the resonator 104 in a projecting fashion.

In one form of the present disclosure, the first cover 130 and the second cover 140 assembled to the upper side of the body 110 also serve as an engine cover, although the first cover 130 and the second cover 140 form a cover of the air cleaner 100. When assembled to the body 110, the second cover 140 may be fixed to a body part forming the enlarged pipe portion 103 by fusion. In FIG. 3, reference symbol 118 indicates a support protrusion 118 fused to a region of the body part forming the enlarged pipe portion 103 corresponding to the lower surface of the second cover 140. The support protrusion 118 is formed at the enlarged pipe portion 103 so as to project upwards from the inner bottom surface of the body 110.

The support protrusion 118 is fused to the lower surface of the second cover 140 assembled to the upper side of the body 110 to fix the second cover 140 to the body 110. In addition, the support protrusion 118 serves to support the second cover 140 at the body 110 and at the same time serves to reinforce rigidity between the body 110 and the second cover 140. In one form of the present disclosure, a plurality of support protrusions 118 may be formed on the inner bottom surface of the body 110, and the plurality of support protrusions 118 stably supports the second cover and reinforces rigidity in the state of being fused to the second cover 140.

When the body 110 and the first cover 130 are coupled to each other, a sealing member 113 may be interposed in a joint between the body 110 and the first cover 130 in a compressed state. That is, when the body 110 and the first cover 130 are coupled to each other, a peripheral part of the filter receiving portion of the body 110 and a peripheral part of the first cover 130 may be joined to each other, and a sealing member 113 made of a rubber material may be interposed between the peripheral parts in a compressed state. The sealing member 113 serves to maintain hermetic sealing such that no air leaks from between the peripheral parts and to inhibit engine noise from being discharged from between the peripheral parts.

The inner structure of the body will be described in more detail with reference to FIGS. 3 to 7. First, the support rib 115, which supports the filter 150 from below, is formed on one side of the inner bottom surface of the body 110 in a projecting fashion. The support rib 115 serves to support the filter 150 in the filter receiving portion 102, and inhibits the filter 150 from being pushed by air introduced through the inlet 111.

In addition, a fixing protrusion 114 configured to support and fix one end of the filter 150 is formed on the other side of the inner bottom surface of the body 110 in a projecting fashion. In one form of the present disclosure, a plurality of fixing protrusions 114 may be formed on the inner bottom surface of the body 110 so as to be disposed at predetermined intervals.

In addition, a seating recess 114*a*, in which one end of the filter 150 is supported in a seated state, is formed in each fixing protrusion 114. At this time, the seating recess 114*a* of each fixing protrusion 114 may be formed so as to have an L-shaped sectional shape. In the case in which one end of the filter 150 is seated in the seating recess 114*a* having the above-described shape, the filter 150 is caught by the inner surface of the seating recess 114*a*, whereby the filter is inhibited from being pushed.

Referring to FIG. 7, the first cover 130 is assembled to the body 110 so as to cover the filter receiving portion and the filter 150 received in the filter receiving portion from above in the inner space of the body 110, and the peripheral part of the first cover 130 and the peripheral part of the filter receiving portion of the body 110 corresponding thereto are joined to each other in the state in which the sealing member 113 is compressed. In addition, the air cleaner 100 according to one form of the present disclosure is disposed obliquely in an engine compartment of a vehicle, as shown, and the filter 150 received in the case 101 of the air cleaner 100 is also disposed obliquely.

At this time, the fixing protrusion 114 is formed on the inner bottom surface of the body 110 so as to project upwards, and the seating recess 114*a*, the sectional shape of which is approximately L-shaped, is formed in the fixing protrusion 114. One end of the filter 150, specifically the lower end of a fixing member 151 (see FIG. 14) located at one end of the filter 150, is supported in the state of being seated inside the seating recess 114*a*. Consequently, in the state in which the fixing member 151 of the filter 150 is supported on the inner surface of the seating recess 114*a* in a joined state, whereby the entirety of the filter 150 may be inhibited from being pushed downwards (in a leftward direction in the figure). In addition, the upper end of the fixing member 151 located at one end of the filter 150 is supported in the state of being caught by the inside of a catching jaw portion 132 (see FIGS. 7 and 14) formed on the lower surface of the first cover 130, whereby the filter 150 may be stably supported by the catching jaw portion 132 of the first cover 130 and the fixing protrusion 114 of the body 110 without being pushed downwards.

Meanwhile, a wall portion 116*a* configured to partition the inner space of the filter receiving portion 102 and the inner space of the enlarged pipe portion 103 from each other is formed on the inner bottom surface of the body 110 along a boundary part between the inner spaces in a projecting fashion. At this time, the peripheral part of the second cover 140 is joined to the peripheral part of the enlarged pipe portion, the peripheral part of the resonator, and the upper end surface of the wall portion 116*a* of the body 110. As a result, the second cover 140 may be assembled so as to cover the inner spaces of the enlarged pipe portion 103 and the resonator 104 from above, and the inner spaces of the enlarged pipe portion 103 and the resonator 104 may be hermetically sealed by the second cover 140.

In addition, a support portion 116*b* may be formed at the surface of the wall portion 116*a* of the body 110 that abuts the inner space of the filter receiving portion 102 so as to extend long along the wall portion in a lateral direction in a projecting fashion, and the support portion 116*b* may be formed at the surface of the wall portion 116*a* in the shape of a plate having a predetermined width. The support portion 116*b* is a portion of the peripheral part of the body to which the peripheral part of the first cover 130 is joined, and the peripheral part of the first cover 130 is joined to the upper surface of the support portion 116*b* in the state in which the sealing member 113 is compressed.

In addition, a coupling portion 116*c* is formed at the surface of the wall portion 116*a* of the body 110 that abuts the inner space of the filter receiving portion 102 so as to be located at the lower side of the support portion 116*b* in a projecting fashion, and a discharge port 153 (see FIG. 11) of the filter 150 is coupled to the coupling portion 116*c*. The discharge port 153 of the filter 150 is a part forming an outlet, through which air filtered by the filter (clean air) is discharged. The coupling portion 116*c* of the body 110 may be formed on the surface of the wall portion 116*a* so as to project by a width greater than the width of the support portion 116*b* at the upper side thereof, and may be formed in the shape of a quadrangular pipe extending long along the wall portion 116*a* in a leftward-rightward direction. An inner path 117 of the coupling portion 116*c* is formed through the wall portion 116*a* between the filter receiving portion 102 and the enlarged pipe portion 103. When filtered air (clean air) is discharged through the discharge port 153 of the filter 150, the filtered air moves to the enlarged pipe portion 103 along the inner path 117 of the coupling portion 116*c*.

A partition wall 116*d* configured to partition the inner path 117 of the coupling portion may be formed at the inner surface of the coupling portion 116*c*. The partition wall 116*d* may be formed so as to vertically interconnect the upper surface and the lower surface of the coupling portion 116*c*, as shown in FIG. 6. At this time, a plurality of partition walls 116*d* may be formed along the coupling portion 116*c* so as to be disposed at predetermined intervals. Consequently, the plurality of partition walls 116*d* may perform the function of a rigidity reinforcement structure configured to inhibit deformation of the coupling portion 116*c* while maintaining the distance between the upper surface and the lower surface of the coupling portion 116*c*.

The coupling portion 116*c* has a shape projecting by a predetermined width P more than the support portion 116*b* (see FIG. 3), to which the sealing member 113 is coupled, as shown in FIG. 6. Consequently, a portion of the coupling portion 116*c* projecting by the width P more than the support portion 116*b* may be inserted inside the discharge port 153 (see FIG. 11) of the filter 150 so as to be coupled thereto. At this time, the inner surface of the discharge port 153 and the outer surface of the coupling portion 116*c* are coupled to each other so as to overlap each other in a joined state. Since the discharge port 153 of the filter 150 is coupled to the coupling portion 116 projecting from the wall portion 116*a* of the body 110, as described above, the coupling portion 116 of the body 110 also serves to support the discharge port 153 of the filter 150.

Referring to FIG. 7, the fixing member 151 (see FIG. 14), located at one end of the filter 150, is supported by the catching jaw portion 132 of the first cover 130 and the fixing protrusion 114 of the body 110, and at the same time a fixing member 152 (see FIG. 14), located at the other end of the filter 150, is supported in the state of being coupled to the coupling portion 116 of the body 110. In addition, the inner path of the coupling portion allows the space inside the filter and the enlarged pipe portion to communicate with each other in the state in which the coupling portion is inserted into the discharge port 153 (see FIG. 11) of the filter 150 formed at the fixing member 152. In addition, the filter 150 is also supported by the support rib 115, formed on the inner bottom surface of the body 110.

Figure 8:
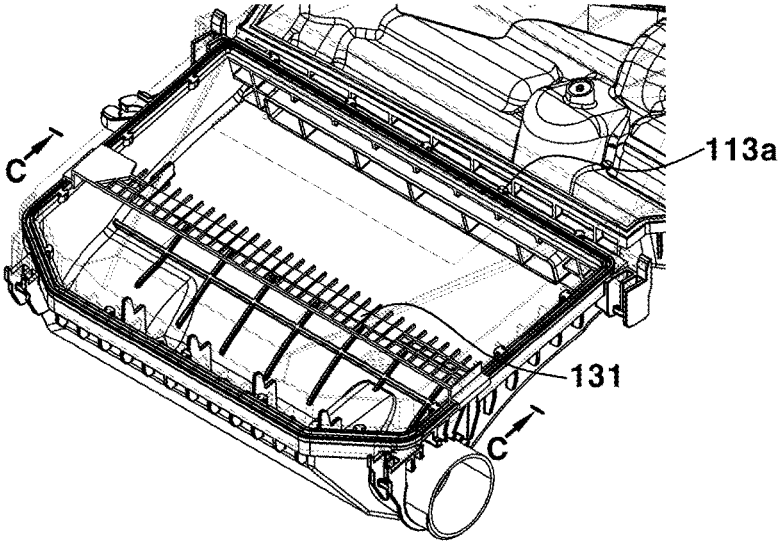
FIG. 8 is a perspective view showing the disposition state of a rigidity reinforcement rib formed on the inner surface of the first cover in the air cleaner according to one form of the present disclosure.

FIG. 8 is a perspective view showing the disposition state of a rigidity reinforcement rib 131 formed on the inner surface of the first cover 130, i.e. the lower surface of the first cover 130, in the air cleaner 100 according to one form of the present disclosure. In one form of the present disclosure, the rigidity reinforcement rib 131 may be formed on the lower surface of the first cover 130. In FIG. 8, the first cover 130 is shown in a transparent state to show the disposition state of the rigidity reinforcement rib 131.

Figure 9:
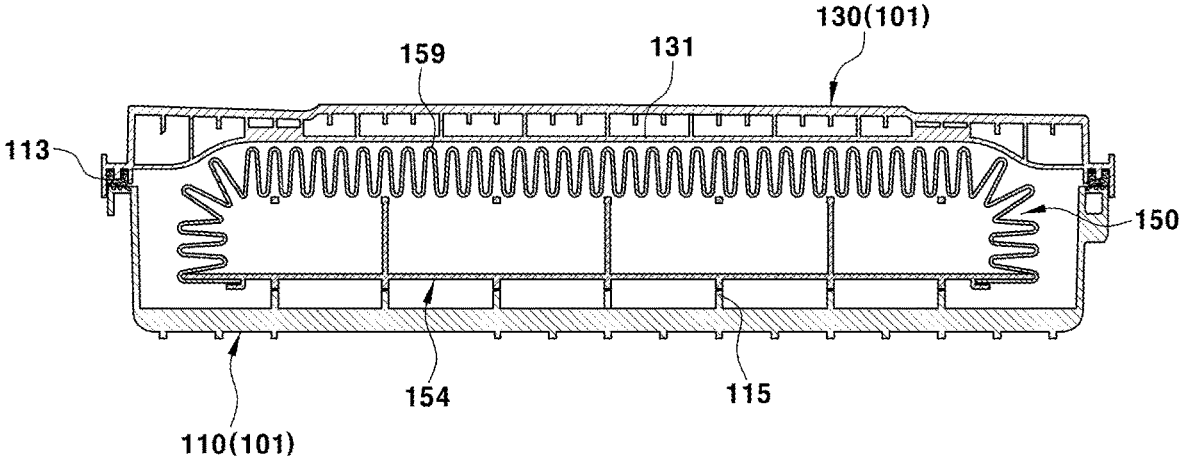
FIG. 9 is a sectional view taken along line C-C of FIG. 8.

FIG. 9 is a sectional view taken along line C-C of FIG. 8. Referring to this, it can be seen that the rigidity reinforcement rib 131 is integrally formed on the lower surface of the first cover 130. The rigidity reinforcement rib 131 may be formed on the lower surface of the first cover 130 so as to extend long in the leftward-rightward direction. At this time, the rigidity reinforcement rib 131 may be formed so as to interconnect left and right side surfaces of the first cover 130 in the form of a bridge. Consequently, the rigidity of the first cover 130 may be reinforced by the rigidity reinforcement rib 131, whereby deformation of the first cover 130 may be inhibited. In addition, the rigidity reinforcement rib 131 of the first cover 130 may also serve to push the filter 150 received in the filter receiving portion 102 of the case 101 downwards. Consequently, a filtration member 159 of the filter 150 may be inhibited from moving upwards and downwards.

In FIG. 5, reference symbol 141 indicates a hydrocarbon trap (HC-trap) 141 installed at the inner surface of the second cover 140, i.e. the lower surface of the second cover 140. As described above, the hydrocarbon trap 141 may be installed in the case 101 of the air cleaner 100. The hydrocarbon trap 141 may be installed to adsorb and collect hydrocarbon, which forms an evaporation gas component of fuel, in the case 101 of the air cleaner 100, and may be fixed to the lower surface of the second cover 140 by fusion, as shown in FIG. 5.

In the case in which the vehicle is stopped and the engine is off, hydrocarbon, discharged from a cylinder of the engine through an intake port may move to the air cleaner 100 through the intake hose 220. For this reason, the hydrocarbon trap 141 is installed in the case 101 of the air cleaner 100 to adsorb and collect hydrocarbon discharged from the cylinder of the engine.

When the engine is started, hydrocarbon collected by the hydrocarbon trap 141 is introduced into the engine together with air introduced into the air cleaner 100, and is burned in the cylinder. In one form of the present disclosure, the hydrocarbon trap 141 may be attached to the lower surface of the second cover 140 so as to be located at the upper side of the inner space of the enlarged pipe portion 103.

In FIG. 8, reference symbol 113*a* indicates an insertion protrusion formed on the sealing member 113. The insertion protrusion 113*a* is configured to be inserted into a recess (not shown) formed in the peripheral part of the first cover 130 so as to be coupled thereto. In one form of the present disclosure, a plurality of insertion protrusions 113*a* may be formed so as to be disposed in a longitudinal direction of the sealing member 113 at predetermined intervals. At this time, the plurality of insertion protrusions 113*a* may be formed on the inner edge of the sealing member 113 or on the outer edge of the sealing member 113. Consequently, the sealing member 113 may be coupled to the peripheral part of the first cover 130 such that each insertion protrusion 113*a* is inserted into a corresponding recess of the first cover 130, and the first cover 130 may be assembled to the body 110 in the state in which the sealing member 113 is coupled thereto.

Meanwhile, air filtered by the filter 150 moves from the enlarged pipe portion 103, which is the clean side, toward the outlet 112. An air guide 119 configured to guide air passing through the inner space of the enlarged pipe portion 103 to the outlet 112 is formed at the inner bottom surface of the body 110 extending from the inner space of the enlarged pipe portion 103 to an outlet side bottom surface, i.e. the outlet 112.

Figure 10:
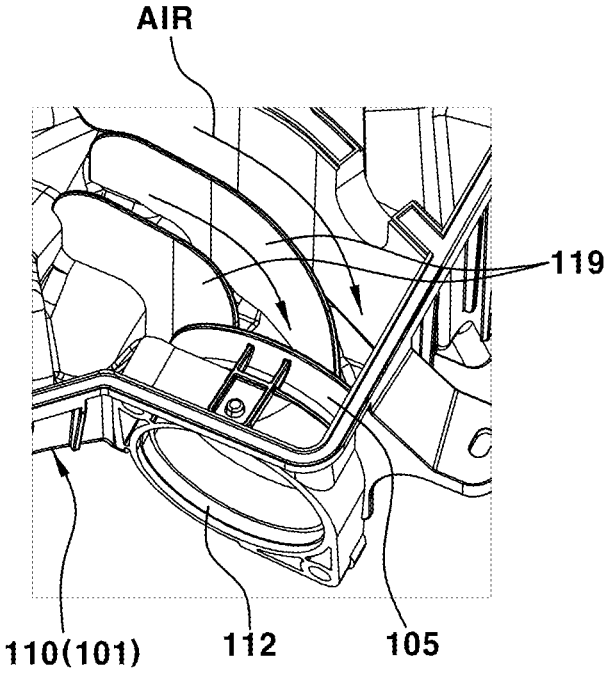
FIG. 10 is a perspective view illustrating an air guide formed on an outlet side of an enlarged pipe portion in the air cleaner according to one form of the present disclosure.

FIG. 10 is a perspective view illustrating the air guide 119 formed on the outlet side of the enlarged pipe portion in the air cleaner according to one form of the present disclosure. In one form of the present disclosure, a plurality of air guides 119 may be formed at the bottom surface of the body 110 so as to be disposed at predetermined intervals. Referring to FIG. 10, it can be seen that air passing through the inner space of the enlarged pipe portion 103 moves to the outlet 112 of the air cleaner 100 along paths between the air guides 119 (see arrows). As the air guides 119 are formed at the outlet side of the enlarged pipe portion 103, as described above, air may naturally move toward the outlet 112 while being guided by the air guides 119, whereby a cavitation phenomenon may be inhibited.

In addition, a leading pipe 105 may be installed at the outlet 112 of the air cleaner 100 together with the air guides 119. Consequently, air guided by the air guides 119 passes through the leading pipe 105 and then moves toward the outlet 112. The leading pipe 105 serves to lead air to the outlet 112 while gathering the air such that air passing through the air guides 119 can naturally move to the outlet 112.

In one form of the present disclosure, the leading pipe 105 may be configured in a cylindrical shape, and the rear end of the leading pipe 105 may be fixed and assembled to the body 110 in state of being inserted inside the outlet 112 of the air cleaner. The front end of the leading pipe 105 may have a larger inner diameter than the rear end of the leading pipe 105, and preferably has an inner diameter gradually decreased toward the rear end of the leading pipe 105. Consequently, air passing through the air guides 119 may be gathered inside the front end of the leading pipe 105 and may then be led to the outlet 112. As a result, air passing from the outlet side of the enlarged pipe portion 103 along the air guides 119 and the leading pipe 105 may be discharged through the outlet 112 of the air cleaner 100 and may then pass through the intake hose 220, in which the airflow sensor (AFS) is installed.

Next, the filter will be described in detail.

Figure 11:
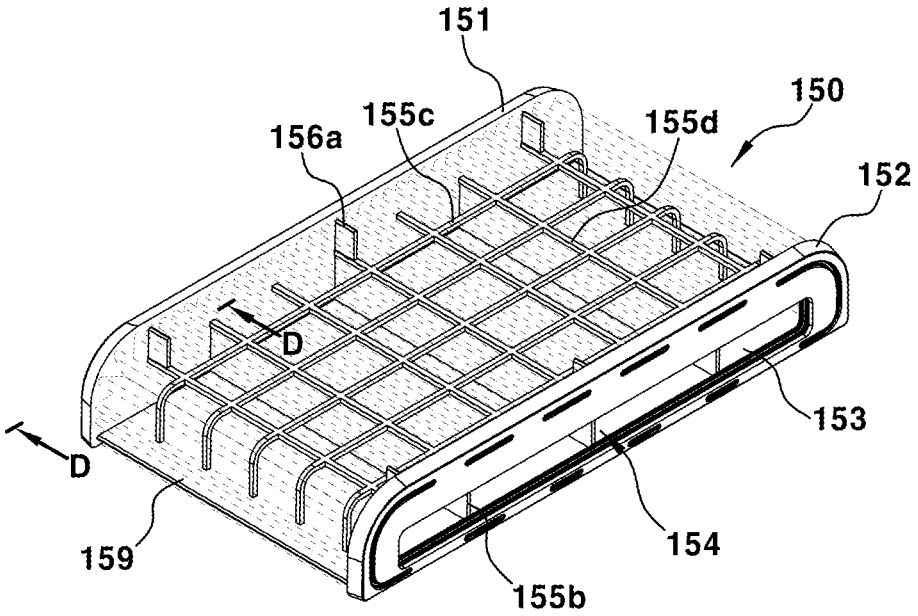
FIG. 11 is a perspective view showing a filter in the air cleaner according to one form of the present disclosure.
Figure 12:
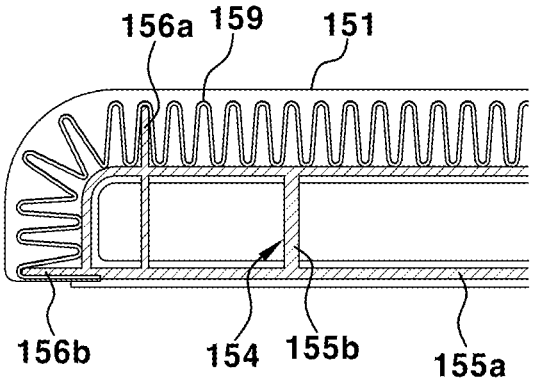
FIG. 12 is a sectional view taken along line D-D of FIG. 11.

FIG. 11 is a perspective view showing the filter 150 in the air cleaner according to one form of the present disclosure, and FIG. 12 is a sectional view taken along line D-D of FIG. 11. As shown in FIG. 7, the filter 150 is received in the filter receiving portion 102 of the air cleaner 100 (the case 101). In one form of the present disclosure, the filter 150 may have a filtration member 159 disposed in a "∩" shape.

The "∩"-shaped filtration member 159 is disposed so as to be open downwards from the filter receiving portion 102 of the case 101. Air introduced into the upper side of the filter 150 in the inner space of the filter receiving portion 102 through the inlet 111 of the case 101 in the air cleaner 100 passes through the filtration member 159 in a downward direction and moves into the filter 150. In addition, air introduced to the lateral side of the filter 150 in the inner space of the filter receiving portion 102 passes through the filtration member 159 in a lateral direction and moves into the filter 150. While passing through the filtration member 159, as described above, foreign matter is removed from the air, and then the air is discharged to the enlarged pipe portion 103 (see the arrow in FIG. 2)

Here, in the inner space of the filter receiving portion 102, the space outside the filter 150 becomes a dirty side space (primary space) into which outside air is introduced, and the space inside the filter 150 becomes a clean side space (secondary space in which air passing through the filtration member 159 (clean air) flows.

In addition, air moving inside the filter through the filtration member 159 is discharged through the discharge port 153 formed in the fixing member 152 located at one end of the filter 150. The discharge port 153 is coupled to the coupling portion 116*c* formed at the wall portion 116*a* of the body 110 (the boundary part between the filter receiving portion and the enlarged pipe portion). Consequently, air moving inside the filter 150 is discharged through the discharge port 153, passes through the inner path 117 of the coupling portion 116*c*, and is introduced into the enlarged pipe portion 103, which is a clean side.

In one form of the present disclosure, the filter 150 may include a filter frame 154, a first fixing member 151, a second fixing member 152, and a filtration member 159. Here, the first fixing member 151 and the second fixing member 152 are coupled to opposite side ends of the filter frame 154. The discharge port 153, which has an approximately quadrangular shape, is formed through the second fixing member 152.

In addition, the lower end of the first fixing member 151 is supported in the state of being seated in the seating recess 114*a* of the fixing protrusion 114 formed at the body 110, and the discharge port 153 of the second fixing member 152 is inserted outside the coupling portion 116*c* of the wall portion 116*a* so as to be coupled and fixed thereto. In addition, a lower plate 155*a* of the filter frame 154 is supported in the state of being seated on the support rib 115 of the body 110.

The filter frame 154 and the filtration member 159 are located between the first fixing member 151 and the second fixing member 152. The filtration member 159 is coupled to the filter frame 154. At this time, the filter frame 154 serves to maintain the shape of the filtration member 159 while fixing and supporting the filtration member 159. In one form of the present disclosure, each of the first fixing member 151 and the second fixing member 152 may be manufactured by foaming polyurethane (PU). In the case in which each of the first fixing member 151 and the second fixing member 152 is made of polyurethane, which is elastic, as described above, the first fixing member 151 and the second fixing member 152 may perform the damping function of an insulator in a filter of a conventional air cleaner.

The filter frame 154 includes a lower plate 155*a* installed at the bottom surface of the case 101 (the bottom surface of the body) so as to be supported via the support rib 115 and a lattice type rod structural member installed at the upper side of the lower plate 155*a* so as to be disposed in a "∩" shape. In this construction, the lower plate 155*a* of the filter frame 154 is supported in the state of being seated on the support rib 115 of the body 110. In addition, the lattice type rod structural member of the filter frame 154 includes a transverse rod 155*c* and a longitudinal rod 155*d*. The transverse rod 155*c* and the longitudinal rod 155*d* are disposed at the upper side of the lower plate 155*a* so as to form a lattice type structure. Consequently, the upper part of the filter frame 154 has a lattice type structure.

Among the rods forming the lattice type structure, a plurality of transverse rods 155*c* is disposed in a direction parallel to the first fixing member 151 and the second fixing member 152, and a plurality of longitudinal rods 155*d* is disposed so as to interconnect the first fixing member 151 and the second fixing member 152. Opposite ends of each transverse rod 155*c* are bent downwards, and opposite ends of each longitudinal rod 155*d* extend downwards so as to be connected to the lower plate 155*a*.

In this construction, the filter frame 154 and the filtration member 159 are located between the first fixing member 151 and the second fixing member 152, and the filtration member 159 is coupled to the upper sides of the transverse rods 155*c* and the longitudinal rods 155*d* disposed in the lattice type structure. The filtration member 159 of the filter 150 is disposed in an inverted "U" shape, i.e. a "∩" shape.

The filtration member 159 may be made of non-woven fabric, and may have a three-layered structure including a bulky layer, an intermediate layer, and a dense layer. At this time, the dense layer is located in a direction toward the clean side, and the bulky layer is located in a direction toward the dirty side. The filtration member 159 is coupled to the upper side of the filter frame 154, and is inhibited from being suctioned inside by the filter frame 154 located at the lower side thereof.

In addition, the filtration member 159 is configured in a bellows structure folded in a zigzag fashion, as shown in FIG. 12. Opposite ends of the filtration member 159 are coupled to the lower plate 155*a* of the filter frame 154. At this time, coupling plates 156*b* configured to extend in a lateral direction are formed at opposite ends of the lower plate 155*a*, and the opposite ends of the filtration member 159 are fixedly coupled to the lower surfaces of the coupling plates 156*b*.

Figure 13:
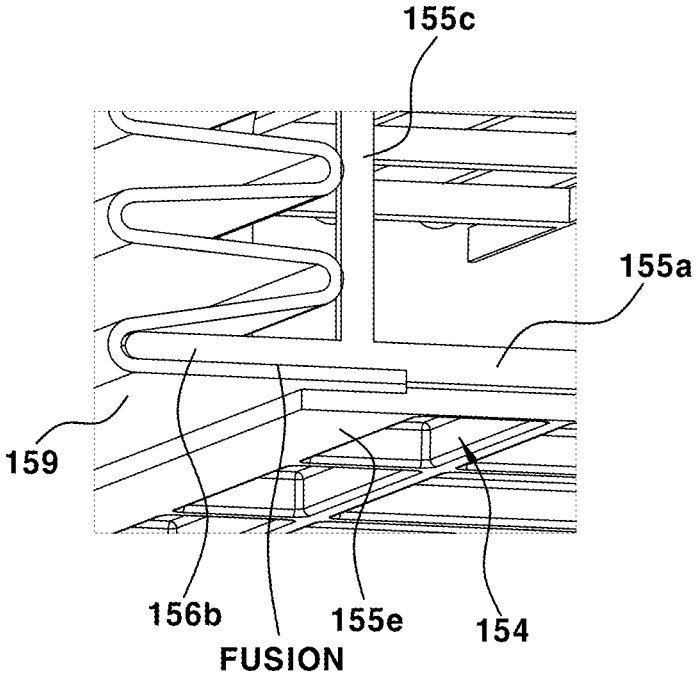
FIG. 13 is an enlarged perspective view showing the state in which opposite ends of a filtration member are coupled to coupling plates of a filter frame in one form of the present disclosure.

FIG. 13 is an enlarged perspective view showing the state in which the opposite ends of the filtration member 159 are coupled to the coupling plates 156 of the filter frame 154 in one form of the present disclosure. As illustrated in FIGS. 12 and 13, the opposite ends of the filtration member 159 are fixed to the lower surfaces of the coupling plates 156*b* of the filter frame 154 by adhesion. At this time, each end of the filtration member 159 may be fixed to the lower surface of a corresponding one of the coupling plates 156*b* by fusion.

In one form of the present disclosure, a guide portion 155*e* may be formed on the lower surface of the lower plate 155*a* in a projection fashion such that a predetermined gap is defined between the lower surface of the lower plate 155*a* and the lower surface of each coupling plate 156*b*. Ultrasonic fusion may be performed in the state in which the end of the filtration member 159 is inserted between the coupling plate 156*b* and the guide portion 155*e*. At this time, the guide portion 155*e* may be formed so as to form a "[]"-shaped sectional shape together with the coupling plate 156*b*.

In the lattice type rod structural member of the filter frame 154, a support stand 155*b* configured to support the entire lattice type rod structural member, including the transverse rods 155*c*, at the lower plate 155*a* may be formed between at least some of the transverse rods 155*c* and the lower plate 155*a*. The support stand 155*b* may be formed so as to interconnect the transverse rods 155*c* and the lower plate 155*a*, and also serves as a partition wall configured to partition the space inside the filter between the filtration member 159 and the lower plate 155*a*.

A coupling protrusion 156*a* may be formed on the upper surfaces of at least some of the transverse rods 155*c* so as to project upwards. The coupling protrusion 156*a* may be formed on a plurality of transverse rods 155*c*. A plurality of coupling protrusions 156*a* is inserted inside the folded part of the filtration member 159 at each position so as to be coupled thereto. Since each coupling protrusion 156*a* is inserted inside the folded part of the filtration member 159 so as to be coupled thereto, as described above, the shape of the filtration member 159 is maintained by the coupling protrusions 156*a*.

Figure 14:
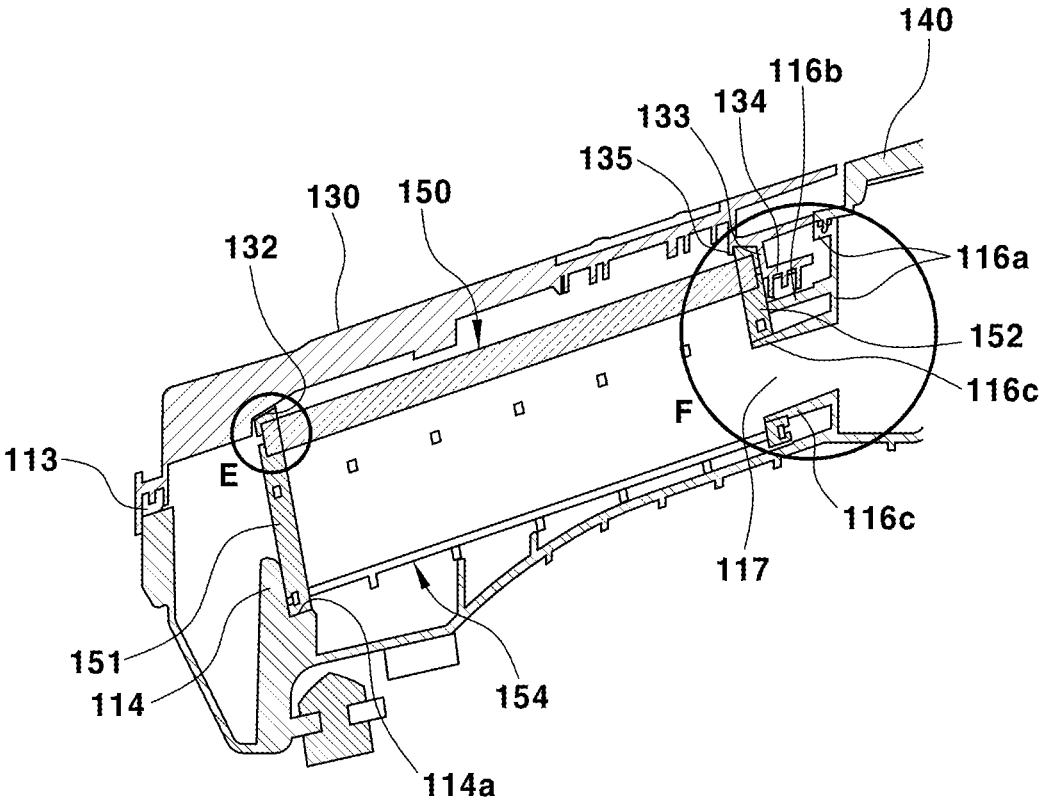
FIGS. 14, 15 and 16 are sectional views showing the state in which the filter is coupled inside a case of the air cleaner in one form of the present disclosure.
Figure 15:
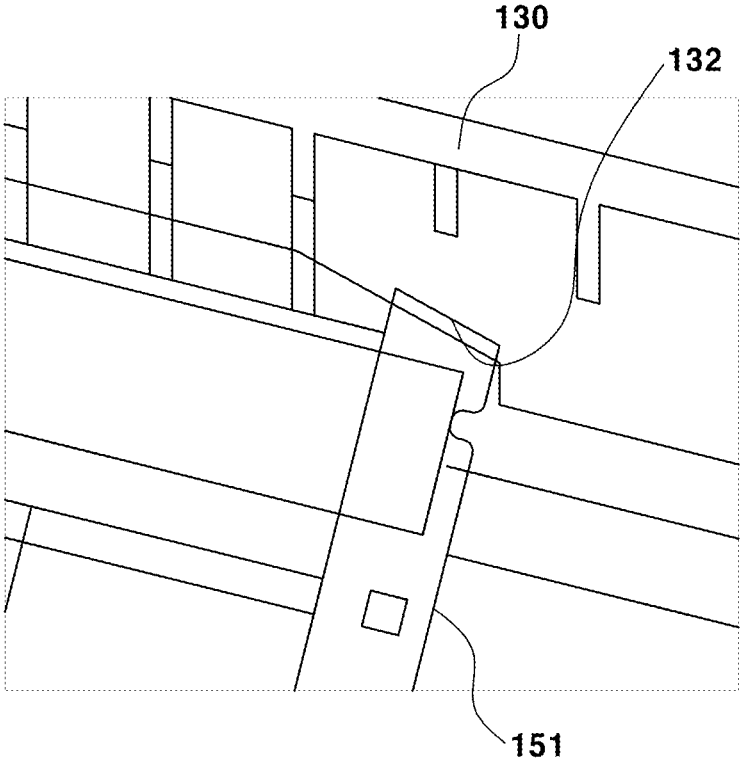
Figure 16:
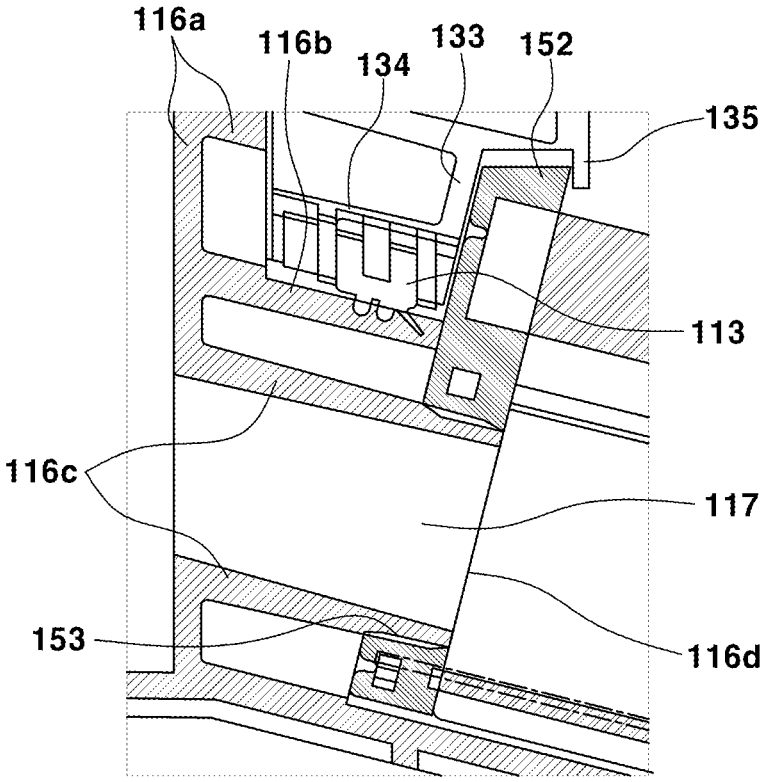

Meanwhile, the state in which the filter 150 is installed in the case 101 of the air cleaner 100 will be described. FIGS. 14, 15 and 16 are sectional views showing the state in which the filter 150 is coupled inside the case 101 of the air cleaner 100 in one form of the present disclosure, wherein FIG. 15 is an enlarged sectional view of part E of FIG. 14 and FIG. 16 is an enlarged sectional view of part F of FIG. 14.

As shown, the first cover 130 is coupled to the body 110 so as to cover the upper side of the filter 150 received in the filter receiving portion 102 of the case 101, and the sealing member 113 is interposed in the joint between the first cover 130 and the body 110 in a compressed state, as previously described. In addition, the lower end of the first fixing member 151 of the filter 140 is supported in the state of being seated in the seating recess 114*a* of the fixing protrusion 114 formed on the inner bottom surface of the body 110. At this time, the upper end of the first fixing member is supported in the state of being caught by the catching jaw portion 132 formed at the lower surface of the first cover 130 (see FIG. 15).

The upper end of the fixing member 151 located at one end of the filter 150 is supported in the state of being caught by the catching jaw portion 132 of the first cover 130, as described above, and at the same time the lower end of the first fixing member 151 is supported in the state of being seated in the seating recess 114*a* of the body 110, whereby the filter 150 may be fixed by the catching jaw portion 132 and the seating recess 114*a* so as not to be pushed downwards. In addition, the filter frame 154 of the filter 150 is supported by the support rib 115 formed on the inner bottom surface of the body 110.

In addition, a bent portion 133 having a bent section and configured to perform a catching action in the state of being in tight contact with the outer surface of the second fixing member 152 of the filter 150 is formed at the lower surface of the first cover 130 so as to project downwards. A joining portion 134 configured to be joined to the support portion 116*b* formed at the wall portion 116*a* in the state in which the sealing member 113 is compressed therebetween is formed at the lower end of the bent portion 133.

In addition, referring to FIG. 16, the discharge port 153 formed through the second fixing member 152 of the filter 150 is assembled in the state of being fitted outside the coupling portion 116*c* formed at the wall portion 116*a* of the body 110. As a result, the inner path 117 of the coupling portion 116*c* of the body 110 communicates with the space inside the filter 150. Since the discharge port 153 formed in the second fixing member 152 of the filter 150 and the coupling portion 116*c* formed at the wall portion 116*a* of the body 110 are coupled to each other in tight contact, as described above, hermetic sealing may be maintained between the space inside the filter 150 and the inner path 117 of the coupling portion 116*c*. In FIG. 16, reference symbol 116*d* indicates a partition wall configured to partition the inner path 117 of the coupling portion 116*c*.

In addition, as shown in FIGS. 14 and 16, a catching protrusion 135 configured to perform a catching action in the state of being in tight contact with the inner surface of the second fixing member 152 of the filter 150 is formed on the bent portion 133 at the lower surface of the first cover 130 so as to project downwards. The upper end of the second fixing member 152 of the filter 150 is inserted between the bent portion 133 of the first cover 130 and the catching protrusion 135 so as to be coupled thereto. As a result, as can be seen from FIG. 16, the second fixing member 152 of the filter 150 is caught by the bent portion 133 of the first cover 130 and the support portion 116*b* in the upward direction (in the leftward direction in the figure) and thus fixed so as not to be pushed upwards.

In addition, when the second cover 140 is assembled to the body 110, the upper end of the second fixing member 152 of the filter 150 is inserted between the bent portion 133 and the catching protrusion 135 so as to be coupled thereto, whereby the second fixing member 152 is fixed so as not to be pushed downwards by the catching protrusion 135 at the opposite side. The catching protrusion 135 is a part configured to perform a catching action in the direction opposite the bent portion 133. The second fixing member 152 may be securely coupled to the first cover 130 by the catching protrusion 135 and the bent portion 133 of the first cover 130, whereby the entirety of the filter 150 maintains a complete coupling state without moving in the case 101 of the air cleaner.

Figure 17:
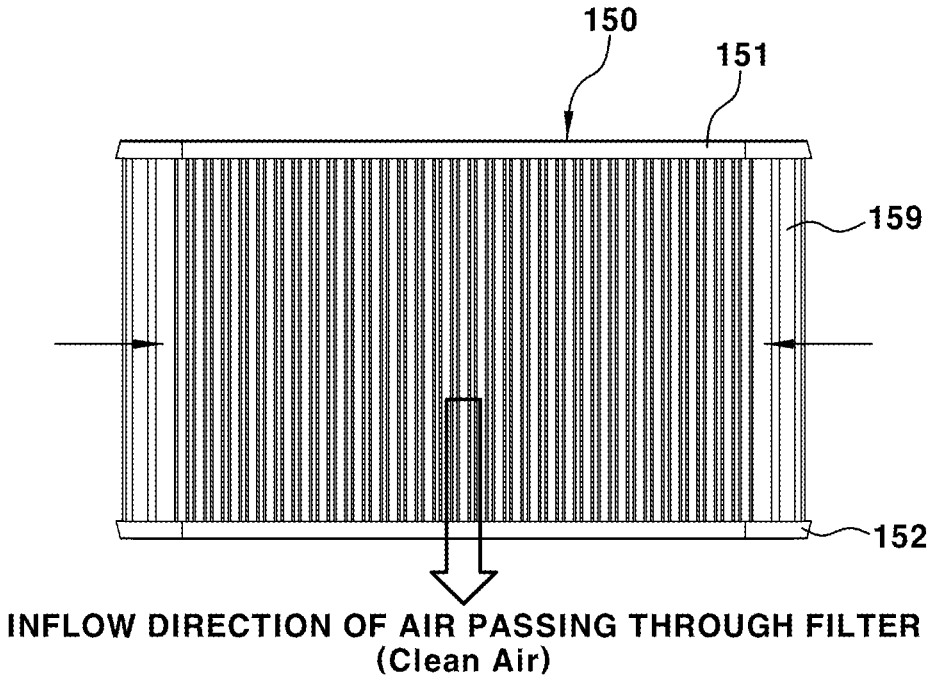
FIGS. 17 and 18 are views showing the direction of air introduced into a filter side and the direction of air discharged from the filter side in the air cleaner according to one form of the present disclosure.
Figure 18:
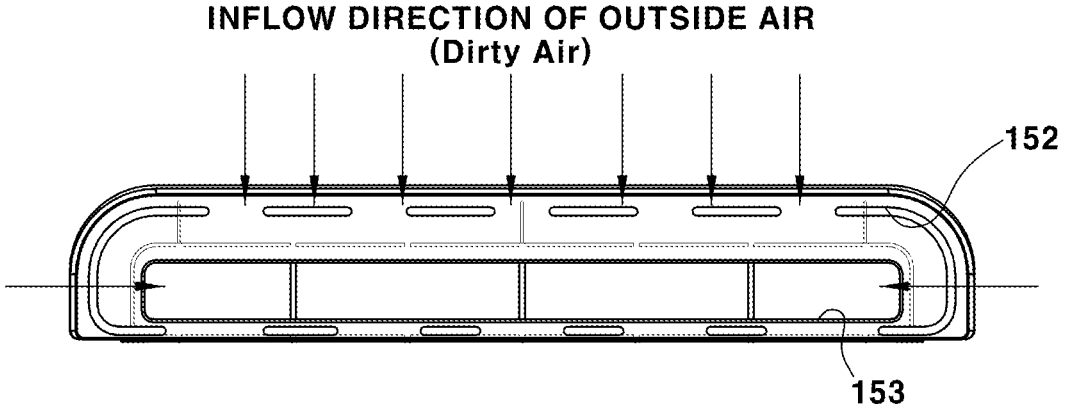

FIGS. 17 and 18 are views showing the direction of air introduced into the filter side and the direction of air discharged from the filter side in the air cleaner according to one form of the present disclosure. As previously described, air passes through the filtration member 159 in the downward direction from the upper side of the filter 150, and at the same time passes through the filtration member 159 in the lateral direction from the lateral side of the filter 140. Air passing through the filtration member 159 (clean air) is discharged through the discharge portion 153 formed in the second fixing member 152 in the space inside the filter.

As is apparent from the foregoing, in the air cleaner according to one form of the present disclosure, the filter may be more stably supported in the case through a simple structure, whereby it is possible to provide excellent dynamic stiffness of the air cleaner and reduce noise. In addition, it is possible to remove undesired parts by simplifying the filter support structure, whereby it is possible to reduce cost and weight and to reduce the height of the filter.

It will be apparent to a person of ordinary skill in the art that the present disclosure described above is not limited to the above forms and the accompanying drawings and that various substitutions, modifications, and variations can be made without departing from the technical idea of the present disclosure.

What is claimed is:

1. An air cleaner for vehicles, the air cleaner comprising:

a case having an inlet, through which outside air is introduced, and an outlet, through which filtered air is discharged; and a filter installed in an inner space of the case, configured to filter the outside air introduced through the inlet, and comprising a filtration member, wherein the filtration member is formed in a "∩" shape open downwards and is configured to allow the outside air to pass therethrough in a downward direction and a lateral direction, wherein the filter comprises:

a filter frame coupled to the filtration member, and including:

a lower plate supported by a bottom surface of the case, and a lattice type rod structural member installed at an upper side of the lower plate in a "∩" shape and coupled to the lattice type rod structural member;

a first fixing member coupled to a first end of the filter frame; and a second fixing member coupled a second end of the filter frame that is located opposite to the first end of the filter frame.

2. The air cleaner according to claim 1, wherein the case comprises:

a body including the inlet and the outlet formed therein;

a filter receiving portion forming an inner space configured to receive the filter;

an enlarged pipe portion forming an inner space configured to receive air filtered by the filtration member, the enlarged pipe portion configured to lead the filtered air toward the outlet; and a cover coupled to an upper side of the body and configured to hermetically seal an inner space defined in the body.

3. The air cleaner according to claim 2, wherein the body further includes a resonator including an inner surface, and the cover comprises:

a first cover coupled to the body and configured to hermetically seal the inner space of the filter receiving portion in which the filter is received; and a second cover coupled to the body and configured to hermetically seal the inner space of the enlarged pipe portion and the inner space of the resonator.

4. The air cleaner according to claim 3, further comprising a support protrusion formed on a bottom surface of the body in the inner space of the enlarged pipe portion, wherein the second cover is supported by the support protrusion in a state in which the support protrusion is fused to a lower surface of the second cover.

5. The air cleaner according to claim 3, further comprising a hydrocarbon trap configured to adsorb and collect hydrocarbon in the enlarged pipe portion, and installed at a part of a lower surface of the second cover.

6. The air cleaner according to claim 2, further comprising:

a fixing protrusion formed on a first side of an inner bottom surface of the body and configured to support a first end of the filter, and a support rib formed on a second side of the inner bottom surface of the body and configured to support the filter from below.

7. The air cleaner according to claim 6, further comprising:

a seating recess formed in the fixing protrusion; and a lower end of the first fixing member located at the first end of the filter, wherein the lower end of the first fixing member is supported in a state of being seated inside the seating recess.

8. The air cleaner according to claim 7, further comprising a catching jaw portion formed at a lower surface of the cover and configured to be supported in a state in which an upper end of the first fixing member is inserted and caught in the catching jaw portion.

9. The air cleaner according to claim 7, further comprising a bent portion formed at a lower surface of the cover and configured to support an upper end of the second fixing member located at a second end of the filter.

10. The air cleaner according to claim 9, further comprising a catching protrusion formed at the lower surface of the cover and configured to catch the upper end of the second fixing member in a direction opposite to a catching direction of the bent portion, wherein the upper end of the second fixing member is inserted between the bent portion and the catching protrusion and coupled to the bent portion and the catching protrusion.

11. The air cleaner according to claim 10, further comprising:

a wall portion formed at the body and configured to partition the inner space of the filter receiving portion and the inner space of the enlarged pipe portion from each other;

a support portion formed at a surface of the wall portion, extending along the wall portion, and abutting the inner space of the filter receiving portion; and a joining portion formed at the bent portion of the cover and configured to be joined to the support portion in a state in which a sealing member is interposed between the joining portion and the support portion.

12. The air cleaner according to claim 2, further comprising an air guide configured to guide the filtered air toward the outlet and formed at a bottom surface of the body from the enlarged pipe portion to an outlet side.

13. The air cleaner according to claim 12, further comprising a leading pipe installed at the outlet and configured to gather and lead the air guided by the air guide to the outlet.

14. The air cleaner according to claim 1, further comprising a coupling protrusion formed on the lattice type rod structural member, and configured to be inserted inside a folded part of the filtration member, coupled to the folded part of the filtration member, and maintain a shape of the filtration member.

15. The air cleaner according to claim 1, further comprising:

a first coupling plate formed at a first end of the lower plate and configured to extend from the first end of the lower plate; and a second coupling plate formed at a second end of the lower plate that is located opposite to the first end of the lower plate and configured to extend from the second end of the lower plate;

wherein a first end of the filtration member is fixedly coupled to a lower surface of the first coupling plate and a second end of the filtration member is fixedly coupled to a lower surface of the second coupling plate.

16. The air cleaner according to claim 15, further comprising:

a guide portion formed on a lower surface of the lower plate; and a predetermined gap defined between the lower surface of the lower plate and the lower surface of each coupling plate, wherein the first end of the filtration member is inserted between the first coupling plate and the guide portion and is fixedly coupled to the first coupling plate and the guide portion, and the second end of the filtration member is inserted between the second coupling plate and the guide portion and is fixedly coupled to the second coupling plate and the guide portion.

17. The air cleaner according to claim 1, further comprising a support stand configured to interconnect the lower plate and the lattice type rod structural member and installed between the lower plate and the lattice type rod structural member.

18. The air cleaner according to claim 1, wherein:

the case includes:

an inner space of a filter receiving portion configured to receive the filter, an inner space of an enlarged pipe portion configured such that air filtered by the filtration member of the filter is introduced thereinto and moves toward the outlet, a wall portion configured to partition the inner space of the filter receiving portion and the inner space of the enlarged pipe portion from each other, and a pipe-shaped coupling portion formed through the wall portion and projecting toward the inner space of the filter receiving portion; and the second fixing member includes a discharge port, through which air passing through the filtration member is discharged from the filter, wherein air passing through the filtration member moves to the enlarged pipe portion through the discharge port and the coupling portion in a state in which the discharge port is coupled to the coupling portion.

19. The air cleaner according to claim 18, further comprising a partition wall formed inside the coupling portion and configured to interconnect an upper surface and a lower surface of the coupling portion, wherein in a state in which the coupling portion is inserted inside the discharge port formed in the second fixing member, an inner surface of the discharge port and an outer surface of the coupling portion are coupled to each other.

* * * * *